US009052164B2

(12) United States Patent
Simovich

(10) Patent No.: US 9,052,164 B2
(45) Date of Patent: Jun. 9, 2015

(54) DYNAMICALLY STRESSED ARMOR

(76) Inventor: Gigi Simovich, Savion (IL)

( * ) Notice: Subject to any disclaimer, the term of this patent is extended or adjusted under 35 U.S.C. 154(b) by 698 days.

(21) Appl. No.: 13/139,842

(22) PCT Filed: Nov. 23, 2009

(86) PCT No.: PCT/IL2009/001096
§ 371 (c)(1),
(2), (4) Date: Jun. 15, 2011

(87) PCT Pub. No.: WO2010/070629
PCT Pub. Date: Jun. 24, 2010

(65) Prior Publication Data

US 2011/0247481 A1 Oct. 13, 2011

(30) Foreign Application Priority Data

Dec. 16, 2008 (IL) ..... IL195978

(51) Int. Cl.
*F41H 5/007* (2006.01)
*F41H 5/04* (2006.01)

(52) U.S. Cl.
CPC ..... *F41H 5/007* (2013.01); *F41H 5/0421* (2013.01); *F41H 5/0428* (2013.01); *F41H 5/0492* (2013.01)

(58) Field of Classification Search
CPC ..... F41H 5/007
USPC ..... 89/36.17, 902; 109/36, 37
See application file for complete search history.

(56) References Cited

U.S. PATENT DOCUMENTS

| | | | | |
|---|---|---|---|---|
| 4,867,077 | A | 9/1989 | Marlow et al. | |
| 5,972,819 | A | 10/1999 | Cohen | |
| 6,474,213 | B1 | 11/2002 | Walker et al. | |
| 6,681,679 | B2 | 1/2004 | Vives et al. | |
| 7,117,780 | B2 | 10/2006 | Cohen | |
| 7,360,479 | B2 | 4/2008 | Yael et al. | |
| 8,387,512 | B2 * | 3/2013 | Warren | 89/36.17 |
| 2004/0118271 | A1 | 6/2004 | Puckett et al. | |

FOREIGN PATENT DOCUMENTS

| | | | |
|---|---|---|---|
| FR | 2526535 | | 11/1983 |
| FR | 2632059 | | 12/1989 |
| FR | 2632059 | A1 * | 12/1989 |
| IL | 88985 | | 3/1995 |

* cited by examiner

*Primary Examiner* — Reginald Tillman, Jr.
(74) *Attorney, Agent, or Firm* — Robert G. Lev

(57) ABSTRACT

The invention relates to a composite armor comprising multiple isolated reactive charges in various shapes and in various configurations. Charges are reacted and dynamically pressurize ceramic elements to reinforce the armor and to disrupt the projectile penetration process. In one embodiment of the present invention an armor comprising a multitude of high tensile strength enclosures are arranged in a closely packed pattern. A ceramic element is disposed in each individual enclosure; a thin inter-layer of explosive material is disposed between the ceramic element and the enclosure's strike face. In a ballistic event, the explosive is set off by an incoming projectile and the ceramic element is thus pressurized and reinforced.

8 Claims, 4 Drawing Sheets

DYNAMICALLY STRESSED ARMOR

FIELD of the INVENTION

This invention is in the field of ballistic armor.

BACKGROUND OF THE INVENTION

Ballistic armor is well known in the art as is herein detailed and described together with explanation why the prior art could be improved or in some essential features is different from the present invention.

U.S. Pat. No. 5,972,819 issued to Cohen reveals ceramic bodies in composite armor where the ceramic bodies end-face curvature is in a specific range of sizes relative to the diameter of the ceramic body.

U.S. Pat. No. 7,117,780 issued to Cohen reveals composite armor plate using a layer of pellets held by elastic material.

French patent No. 2526535 issued to Pequignot reveals ceramic elements embedded into a metallic plate and thermally stressed.

In Israeli Patent application No. 88985 by Benyami, an ad-on reactive armor element is proposed, the proposed armor is a multi layer composite body wherein an intermediate inert body is sandwiched between explosive layers and covered with a cover plate.

Walker et al in their U.S. Pat. No. 6,474,213 propose a reactive armor that comprises a layer of reactive element that provides support to an outer layer and delay its fracture.

Dubot et al. in French patent application No 2632059 proposes an armor for protection against hollow charges that comprises a ceramic or silica based blocks in various configurations surrounded by walls, the walls are externally at least partially covered by a layer of explosives that are triggered at the time of impact.

Tranchet et al have published in the journal de physique IV in their article: "A numerical investigation of high velocity impact onto a ceramic block" that a ceramic block hit by a projectile impacting with a soft sabot attached to the projectile is more immune to penetration than a ceramic block hit by a free projectile. The increased immunity is believed to come from the dynamic pressure exerted by the impacting sabot onto the ceramic block around the projectile impact point.

The above prior art uses different methods to increase the impact absorption factor of armor by subjecting ceramic elements to stress or providing efficient confinements and configurations.

DISCLOSURE OF THE INVENTION

The present invention reveals an armor comprising a configuration of multiple ceramic elements arranged in an efficient pattern that provides mutual confinement of elements or members, and minimum gaps between ceramic elements. The present invention also provides an efficient dynamic reinforcement of the individual members that are involved in a ballistic event and leaves other members in the armor intact, a limitation of the number of charges that are reacted is achieved by providing insulation between the charges. The insulation in the present invention also acts as a pressure amplifier and/or has favorable ballistic properties.

The use of high tenacity fiber materials, rubber, foils like paper and aluminum foils, in the insulation, can also reduce collateral injury from debris.

The advantages of dynamic stressing of ceramic armor elements over pre-stressed armor are:

The use of high tensile strength and high creep materials is made possible for the enclosures, for example Aluminum and organic fibers like aramides and polyethylenes.

These materials are usually lighter or cheaper than their counterpart low creep materials like steel, titanium and carbon fibers.

The creep property of the materials is not important in the very short time of stressing of the dynamically stressed armor.

The pressure provided by a dynamically stressed enclosure in combination with the acceleration of reacted gasses and debris of insulation or enclosure materials can provide higher pressure to the ceramic pellets than the pressure of a static tensioned pre-stressed enclosure.

Reinforcing pressure waves can sometimes also travel deeper into the ceramic element than the superficial influence of static pressure in some instances.

SUMMARY OF THE INVENTION

It is to be understood that both the foregoing general description and the following detailed description present embodiments of the invention and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention but not to limit the invention to these descriptions only.

DEFINITIONS

Reactive material will hereinafter refer to a material that stores chemical energy and can react and release hot gases in some instances in the description of the present invention; a reactive material also refers to a material that releases hot gases when a high energy electrical current is run through it.

For example; high explosive, primary explosive, gun powder and mixture of aluminum powder and ammonium nitrate.

Prism Like Shape:

Prisms are solid figures whose bases or ends are polygons that have the same size and shape and are parallel to one another, and each of those sides is a parallelogram.

Prism-like shape in this description will refer to a solid figure whose bases or end surface projection is a polygon or shapes with optionally curved segments. This shape is of uniform parallel cross section, its lateral surfaces are flat or single curved, the locus of the center of gravity of each parallel cross section is on a straight line, parallel to the lateral surfaces, which will be referred to as the shape axis.

Longitudinal direction in this description will refer to the direction that is perpendicular to the local armor surface.

Radial direction in this description will refer to a direction perpendicular to the longitudinal direction.

Honeycomb-like arrangement in this description will refer to an arrangement of uniform closely packed shapes in a layer wherein the shapes are cylindrical, hexagonal prisms or hexagonal prism-like shapes with recessed corners.

The shapes may comprise of various end surfaces.

The axis of each shape is perpendicular to the layer.

The shapes are arranged in parallel rows wherein each non peripheral shape is in contact or attached to two other consecutive shapes in each of the two adjacent rows and two other adjacent shapes from its own row.

Ceramic pellet: A ceramic pellet in this description will refer to a ceramic element shape which is predominantly cylindrical, hexagonal prism or hexagonal prism-like shape with recessed corners. The pellet may comprise of various end surface shapes.

The present invention relates to a composite armor comprising multiple insulated reactive charges.

The armor further comprises at least one hard layer that comprises at least one ceramic element. The insulated charges are attached to the ceramic. In a ballistic event one or more charges are reacted by impacting projectile or by other external means, the reacted charges deliver an impulse to the local ceramic and increases its ability to resist penetration. The insulation of the charges prevents the reaction from propagating further to other adjacent charges, reduces the amount of collateral damage and leaves the rest of the armor undamaged and effective. One preferred method for achieving isolation is to position the reactive charges in dimples provided in the ceramic strike surface and providing an inert cover to the charges.

A preferred method for triggering and initiating the charges is by the energy of impacting projectiles.

The charges can optionally be triggered by projectile detection means like optical, acoustical, radar and a detection plate wherein a projectile passing through the plate closes an electrical circuit. In these cases the reactive charges are preferably initiated by an electrical initiator blasting cap. This can also enable to initiate the charge before the projectile actually impacts the armor. The use of multiple detection plates or high resolution projectile detection means enables the activation of the local charges close to the location that is likely to be hit.

In a variation of the present invention a high energy electric charge is used as a main energy source for the reactive charges, a high energy electrically charged capacitor is discharged through the reactive charge and through electrical leads and an electrical switching device which is opened by the projectile detector.

Several embodiments of the present invention provide a composite armor comprising multiple members in a honeycomb-like arrangement; each member comprises a ceramic element that is dynamically stressed when hit by a projectile.

Each ceramic element is dynamically stressed by a sudden pressurizing action at the ceramic element surface.

This is achieved by an explosion of a small explosive charge, or a discharge of a high energy electric charge into an electrically conductive reactive material attached to the ceramic element.

The members are arranged in a layer in a tightly packed pattern that provides a uniform and efficient protection against projectiles of determined types and energy.

In one preferred embodiment of the present invention a composite armor comprising ceramic pellets having a circular cross-section, hexagonal or hexagonal with recessed corners cross-section, are each disposed in an enclosure. A reactive material like high explosive is disposed in a thin layer between selected parts of each enclosure surface and the pellet. The preferred ratio between the maximum lateral dimensions of the pellet to its longitudinal dimension is in the range 3.0 to 0.60. The members are bonded to each other with a binder like rubber or epoxy cement.

Alternatively the multiple enclosures can be made of one piece or diffusion bonded. This arrangement can also be provided with a pre-stressed enclosure, wherein the enclosure is under tension and the pellet is pressurized.

In another preferred embodiment of the present invention a dynamically stressed armor comprises a hard armor layer that comprises ceramic pellets disposed in a honeycomb-like arrangement. An isolated reactive charge is attached to one or both end faces of each pellet.

The isolation is achieved by an inert material that covers fences or encapsulates the individual charges.

The ceramic pellets are contiguous which assures minimum gaps between the pellets.

In a ballistic event local charges are reacted for example by the impact energy of the incoming projectile. The acceleration of reacted gasses and debris of insulation or enclosures provide high pressure to the ceramic pellets and increases its ballistic protection properties.

It has been found that the use of a convex strike face provides increased resistance to ceramic armor elements.

A convex strike face in a dynamically stressed armor further provides an improved shape of enclosure which resembles the shape of pressure vessels. This results in faster increase in the pressure around the impact point, lower structural weight and beneficial concentration of the pressure waves in the ceramic.

In another preferred embodiment of the present invention a dynamically stressed armor comprises a hard ceramic layer that comprises ceramic elements.

In one variation of that embodiment the ceramic layer comprises of a monolithic ceramic plate. In another variation of that embodiment the ceramic layer comprises a multiplicity of ceramic elements like tiles, pellets or rods arranged in a contagious arrangement. The armor comprises a reactive layer disposed in front of the ceramic layer, or positioned on both sides of the ceramic layer. The positioning of the reactive layer behind the ceramic layer is not favored since it may disrupt the bonding of the ceramic layer to the backing and also deliver a high impulse to body organs or equipment behind the armor. The reactive layer comprises multiple isolated reactive charges. In a ballistic event local charges are reacted for example by the impact energy of the incoming projectile. The acceleration of reacted gasses and debris of insulation or enclosures, provide high pressure to the local ceramic layer and increases its ballistic protection properties.

In one embodiment of the present invention a dynamically stressed armor comprises a plurality of contagious ceramic pellets in a honeycomb-like arrangement wherein one isolated reactive charge is attached to one or both of the end faces of each pellet. In this arrangement the gaps between the ceramic pellets are minimal.

The isolation of the reaction in the present invention is achieved by an inert material that covers fences or encapsulates the individual charges.

The charges can also be isolated by disposing them into dimples in the ceramic surface.

In another embodiment of the present invention a dynamically stressed armor comprises a plurality of contagious hollow rods; the rods are arranged in parallel in one layer. Ceramic bodies and isolated charges are disposed in the hollow rods whereas each ceramic body is attached to at least one isolated charge.

In a variation of this embodiment the parallel hollow rods are formed as one hollow board of multiple parallel cavities.

This variation can provide a high structural strength dynamic armor.

It is also in the scope of the present invention to provide an armor that comprises an auxiliary layer disposed in front thereof at a determined distance wherein said layer comprises multiple dynamically stressed ceramic elements arranged preferably in a spacious pattern. Multiple isolated reactive charges are attached to the ceramic elements. In a ballistic event local reactive charges are initiated and increase the armor ballistic resistance. The auxiliary layer reduces the impacting energy of an incoming bullet and more important, it has a high lateral gradient of penetration resistance that statistically turns the axis of an incoming projectile at an angular velocity away from its velocity vector. This causes the projectile to hit the main armor layer at reduced speed and an unfavorable angle of attack for penetration.

In the auxiliary layer, gaps between adjacent ceramic elements are allowed to be substantially bigger.

In a preferred embodiment of the present invention, hollow rods are arranged in a spacious grating shaped pattern in an auxiliary armor layer disposed in front of the main armor layer at a determined distance. Multiple ceramic elements are disposed within the hollow rods at determined gaps separated by isolated explosive charges. When a rod is impacted by an incoming projectile, local explosive charges are exploded; reinforcing the adjacent ceramic elements and with a high probability causing the projectile to reach the main armor at an unfavorable angle of attack for penetration and with reduced energy.

BRIEF DESCRIPTION OF THE DRAWINGS

The accompanying drawings, which are incorporated in and form a part of this specification, illustrate embodiments of the invention and together with the description, serve to explain by way of example only, the principles of the invention.

The layer comprises multiple members arranged in spacious grating pattern at a determined distance ahead of the main armor layer. The main armor layer is not shown.

DETAILED DESCRIPTION OF THE PREFERRED EMBODIMENTS

As will be appreciated the present invention is capable of other and different embodiments than those discussed above and described in detail below, and its several details are capable of modifications in various aspects, all without departing from the spirit of the invention. Accordingly, the drawings and description of the embodiments set forth below are to be regarded as illustrative in nature and not restrictive.

Figure 1:
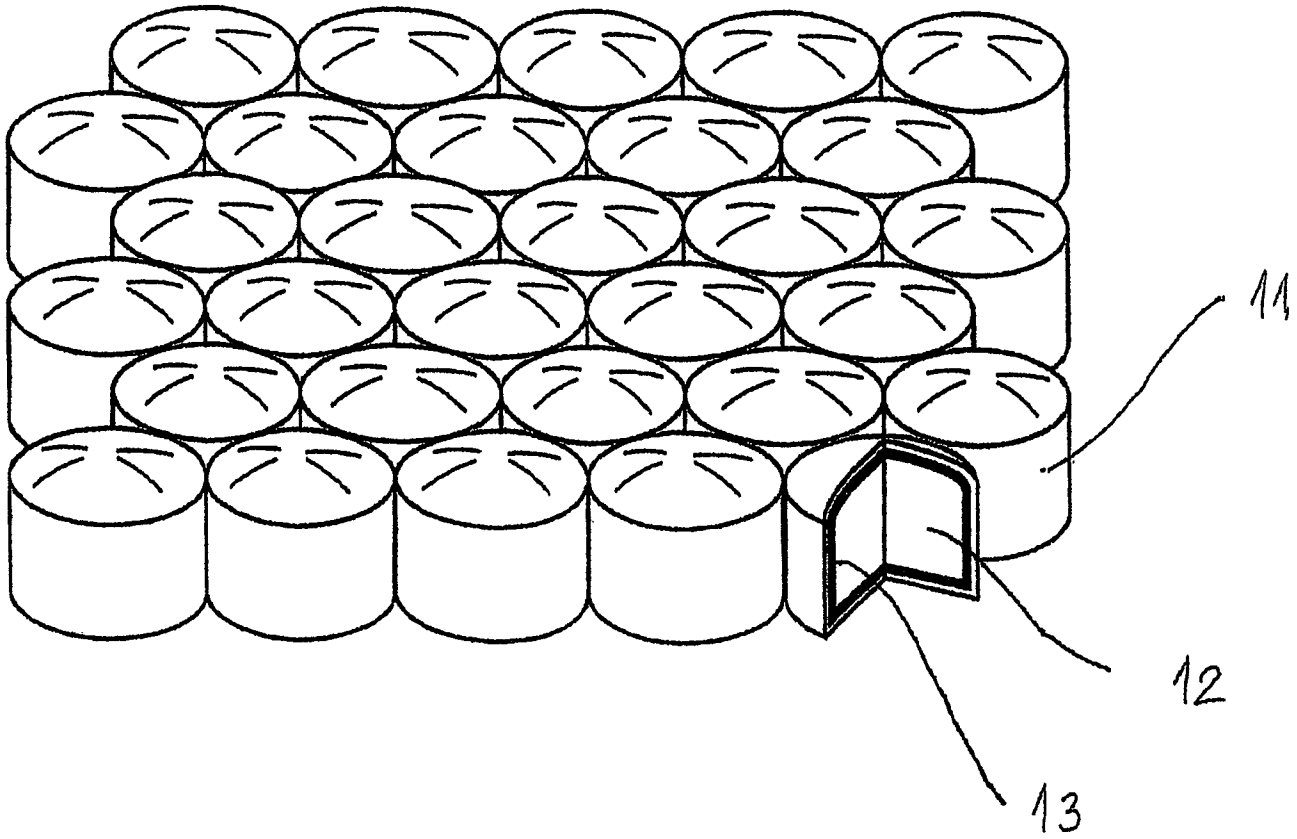
FIG. 1 is a schematic depiction in isometric projection with broken view of multiple dynamically stressed armor members disposed in a layer in a honeycomb like arrangement. The armor's facing layer and backing layer are not shown.

FIG. 1 shows a view of multiple cylindrical dynamically stressed armor members disposed in a layer in a honeycomb like arrangement. The armor's facing layer and backing layer are not shown.

Each member comprises an aluminum encapsulating enclosure 11. A cylindrical pellet 12 is disposed in each enclosure 11. A thin explosive interlayer 13 is provided between the enclosure and pellet.

The strike face of the pellet and the enclosure is dome shaped and convex. The members are arranged in one layer in a honeycomb-like arrangement.

Figure 2:
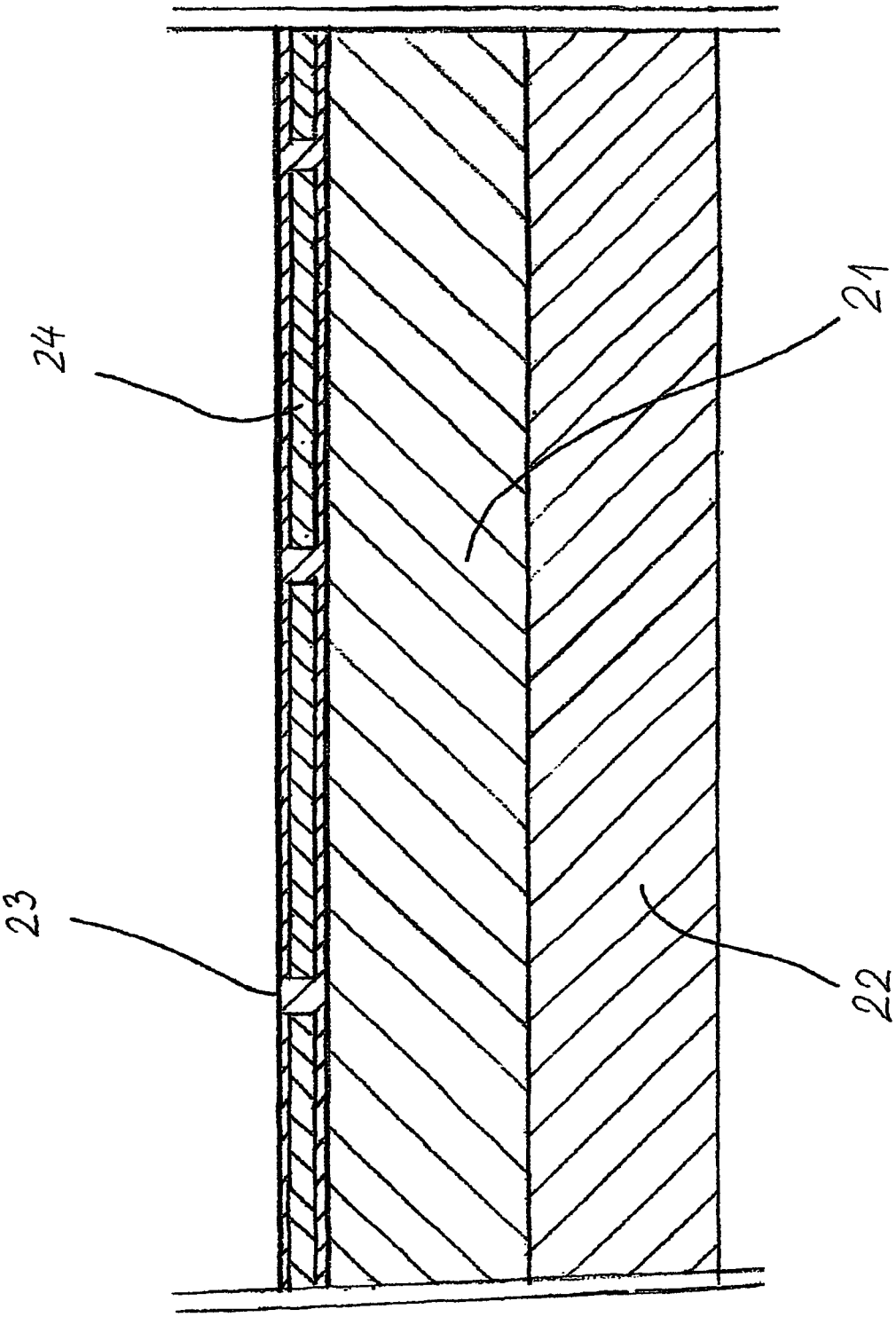
FIG. 2 is a schematic depiction in sectional view of a dynamically stressed armor that comprises a ceramic plate, a reactive layer disposed in front thereof and a backing layer.

FIG. 2 shows a schematic depiction in sectional view of a dynamically stressed armor that comprises a ceramic plate 21, a reactive layer disposed in front thereof and a backing layer 22 which comprises unidirectional UHMWPE fibers. The reactive layer comprises multiple thin isolated explosive charges 24. The charges are isolated by aluminum isolation 23. In a ballistic event impacted charges are initiated delivering an impulse to the ceramic plate. The impulse creates pressure waves that delays cracks and reinforces the ceramic plate. The isolation material stops the propagation of the explosive wave to adjacent charges.

Figure 3:
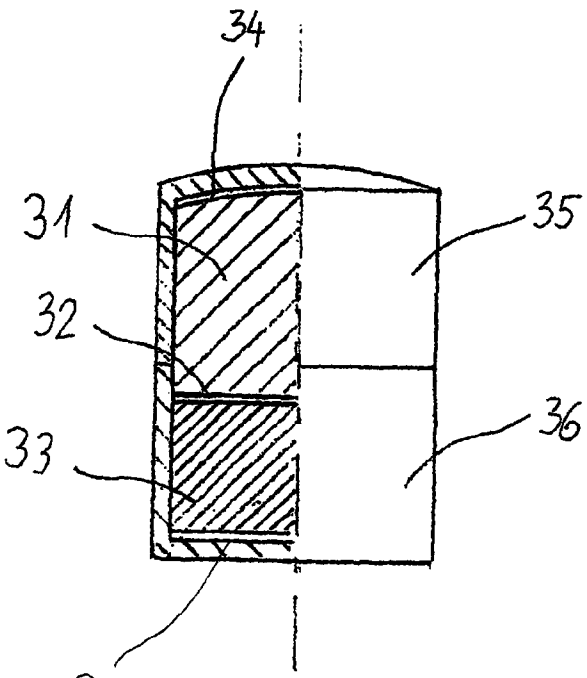
FIG. 3 is a schematic depiction in half sectional view of an encapsulated dynamically stressed armor member. The member comprises two ceramic pellets disposed in an encapsulating enclosure.

FIG. 3 shows a schematic depiction in half sectional view of an encapsulated dynamically stressed armor member. The member comprises two ceramic pellets 31, 33 disposed in an encapsulating enclosure 35, 36. Explosive charges 34, 32, 37 are disposed at the pellets strike faces and backing faces. The members are to be arranged in a honeycomb-like arrangement in an armor layer.

Figure 4A:
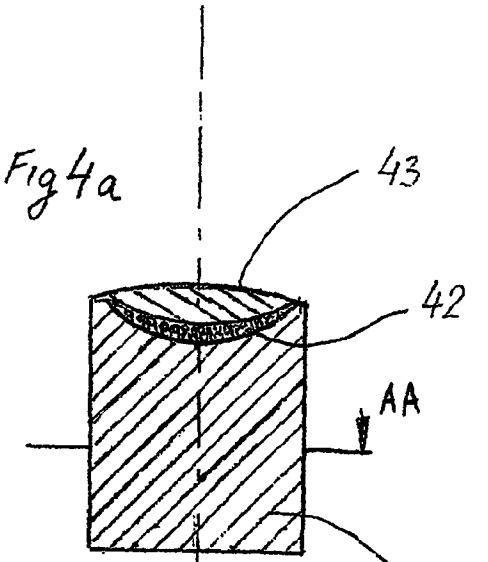
FIG. 4*a* is a schematic depiction in sectional view of a hexagonal dynamically stressed ceramic pellet provided with a dimpled strike face and an explosive charge disposed at its strike face.
Figure 4B:
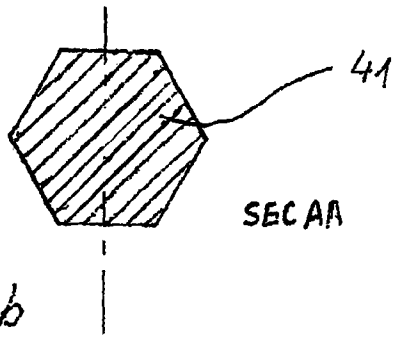
FIG. 4*b* is a cross section of the pellet depicted in FIG. 4*a*

FIGS. 4*a* and 4*b* show a schematic depiction in sectional view of a hexagonal dynamically stressed armor member that comprises; a ceramic pellet 41 provided with a dimpled strike face and an explosive charge 42 disposed at its strike face. An isolation cover 43 protects the explosive charge and augments the impulse delivered to the ceramic pellet when the charge is reacted.

This member when arranged in a honeycomb-like arrangement provides a dynamically stressed armor with no gaps between the ceramic pellets and thus provides a relatively uniform protection level.

Figure 5:
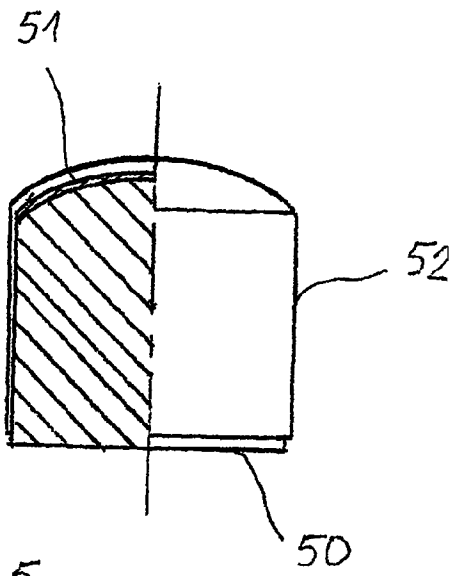
FIG. 5 is a schematic depiction in half sectional view of an enclosed pellet that is provided with a convex dome shaped strike face. An explosive layer is provided between the pellet's strike face and the enclosure.

FIG. 5 shows a schematic depiction in half sectional view of an enclosed pellet 50 that is provided with a convex dome shaped strike face. An explosive layer 51 is provided between the pellet's strike face and the enclosure 52.

Figure 6:
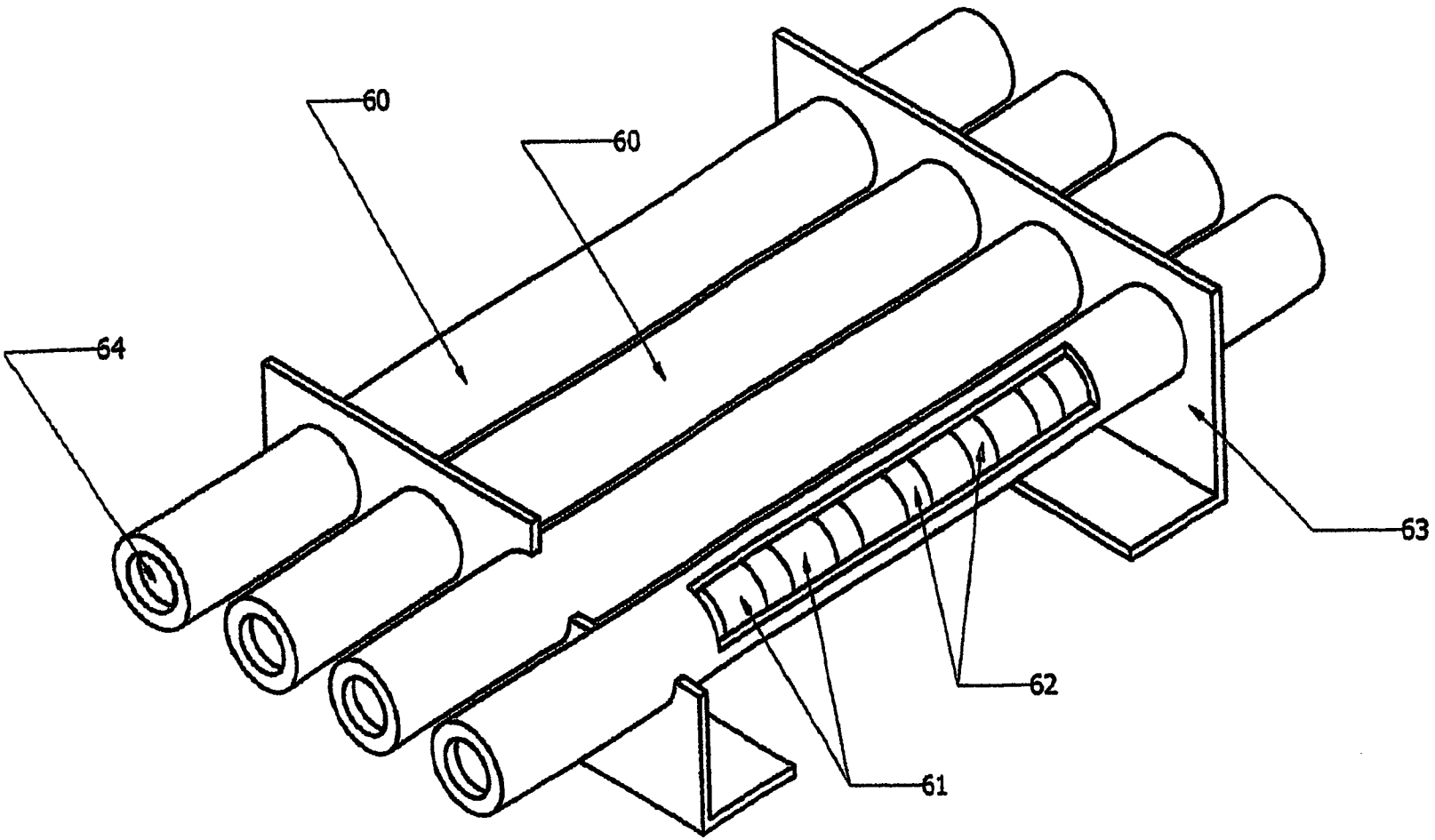
FIG. 6 is a schematic depiction in isometric projection with broken view of a dynamically stressed auxiliary armor layer.

FIG. 6 shows a schematic depiction in isometric projection with broken view of a dynamically stressed auxiliary armor layer.

The layer comprises multiple members arranged in spacious grating pattern at a determined distance ahead of the main armor layer.

Each armor member comprises a hollow aluminum tube 60.

Multiple ceramic elements 61 are disposed in each tube.

Multiple isolated and encapsulated explosive charges 62 are disposed in the tube and attached between the ceramic elements 61.

A plug 64 is provided to each end of the tube.

Holding brackets 63 keep the members in a determined distance from the main armor.

The main armor layer is not shown.

The present invention is not intended to be limited to the embodiments described above, but the encompass any and all embodiments within the scope of the following claims:

1. A ballistic armor comprising:

a) a plurality of enclosures, each enclosure having a cavity, and wherein said enclosures are arranged in a contiguous honeycomb-like arrangement in a layer;

b) a plurality of ceramic bodies are disposed in each enclosure cavity, the ceramic bodies being selected from the group consisting essentially of cylindrical shapes, hexagonal prisms and hexagonal prism-like shapes with recessed corners, and wherein a reactive material is disposed between the bodies; and c) wherein the reactive material is activated to pressurize the enclosures during a local ballistic event comprising an impacting projectile.

2. The ballistic armor according to claim 1, wherein said ceramic body comprises a convex strike face.

3. The ballistic armor according to claim 1 wherein said enclosures comprise a material from the group consisting of metals, rubbers, foils and continuous fibers.

4. The ballistic armor of claim 3 whereby the pressure exerted onto said ceramic bodies reinforces the armor.

5. The ballistic armor of claim 1 wherein said reactive material is an explosive material.

6. The ballistic armor according to claim 1 wherein said reactive material is initiated by electric discharge.

7. The ballistic armor according to claim 1 wherein said reactive material initiation is triggered by an incoming projectile detection means.

8. The armor of claim 1 further comprising an auxiliary layer comprising hollow rods enclosures arranged in a grating pattern, and wherein multiple ceramic elements are disposed in each enclosure, and said reactive material is either: (i) initiated by an electric discharge, or (ii) triggered by an incoming projectile detection means.

* * * * *